US005338117A

United States Patent [19]

Kucksdorf et al.

[11] Patent Number: 5,338,117

[45] Date of Patent: Aug. 16, 1994

[54] BAG AND METHOD OF MAKING THE SAME

[75] Inventors: Arthur E. Kucksdorf; Jeffrey D. Muhs; Scott D. Hammer, all of Ames, Iowa

[73] Assignee: American Packaging Corporation, Philadelphia, Pa.

[21] Appl. No.: 9,653

[22] Filed: Jan. 27, 1993

[51] Int. Cl.[5] ..... B65D 33/08; B65D 33/36

[52] U.S. Cl. ..... 383/9; 383/10; 383/89; 383/906; 229/204

[58] Field of Search ..... 383/9, 10, 88, 89, 125, 383/126, 906; 229/139, 204

[56] References Cited

U.S. PATENT DOCUMENTS

| | | | |
|---|---|---|---|
| 1,833,675 | 11/1931 | Geimer | 383/906 X |
| 1,947,934 | 2/1934 | Geimer | 383/906 X |
| 2,034,594 | 3/1936 | Norris et al. | 229/139 X |
| 2,355,313 | 8/1944 | Lurie | 383/906 X |
| 2,470,789 | 5/1949 | Palmer | 383/906 X |
| 2,948,457 | 8/1960 | Thiele | 383/906 X |
| 4,235,366 | 11/1980 | Achelpohl et al. | 383/906 X |
| 4,864,090 | 9/1989 | Maxwell et al. | 383/125 X |

FOREIGN PATENT DOCUMENTS

| | | | |
|---|---|---|---|
| 2755514 | 6/1979 | Fed. Rep. of Germany | 383/906 |
| 0083774 | 5/1954 | Norway | 383/126 |

*Primary Examiner*—Allan N. Shoap
*Assistant Examiner*—Jes F. Pascua
*Attorney, Agent, or Firm*—Frank A. Follmer

[57] ABSTRACT

A bag of the leakproof square ended type having an end formed by a first fold portion having a rectangular tab and a triangular fold portion is made with the tab secured to a central portion of the end with the triangular fold portion inserted beneath the tab so as to be held thereby in a releasable position, the triangular fold portion being manually removable from said releasable position for use in providing a pour spout. The bag end may also be provided with a handle means for use in carrying and/or dispensing purposes.

10 Claims, 11 Drawing Sheets

FIG. 1
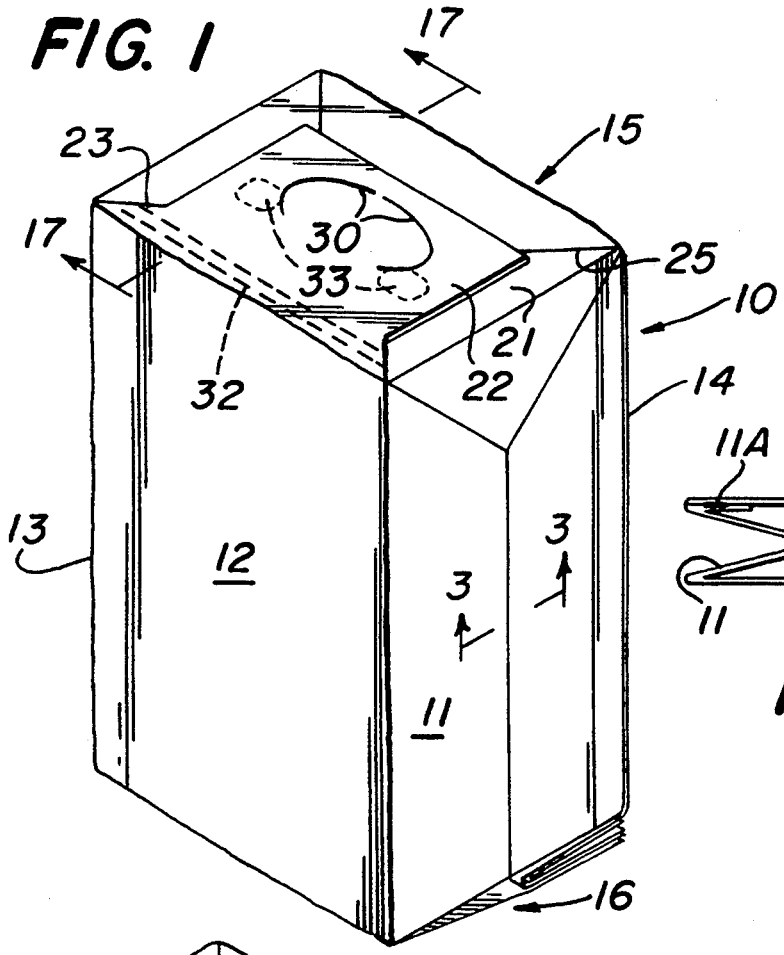
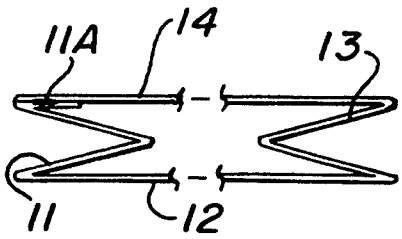
FIG. 4A
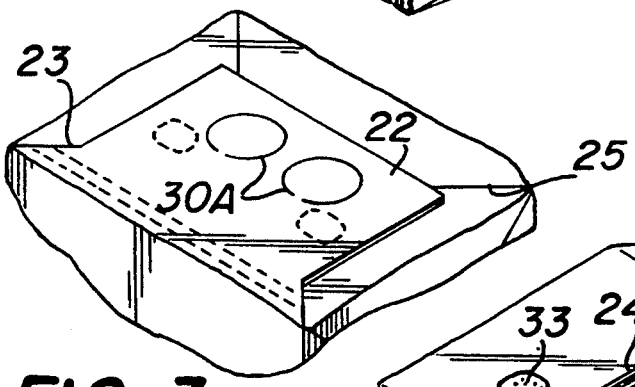
FIG. 3
FIG. 2
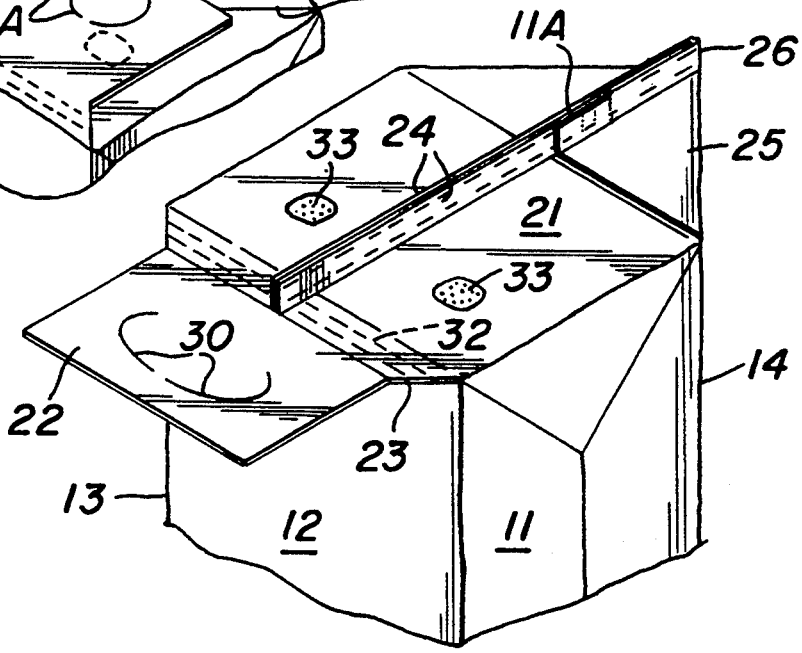

FIG. 14
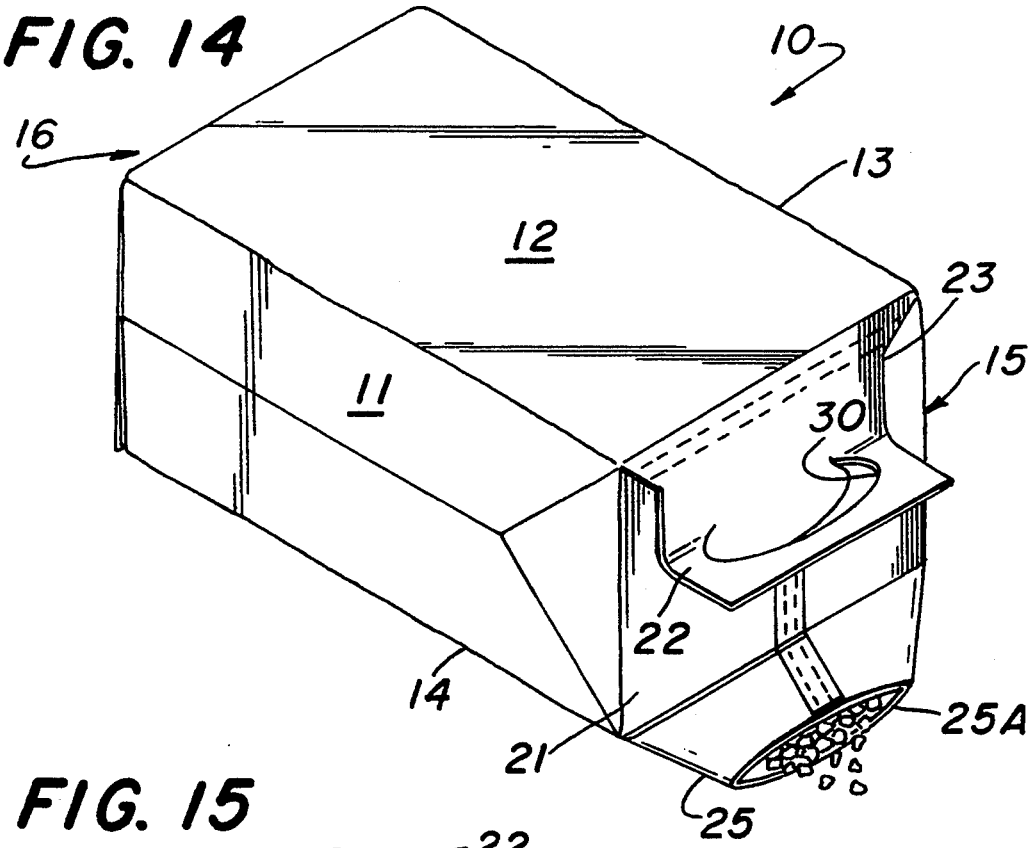
FIG. 15
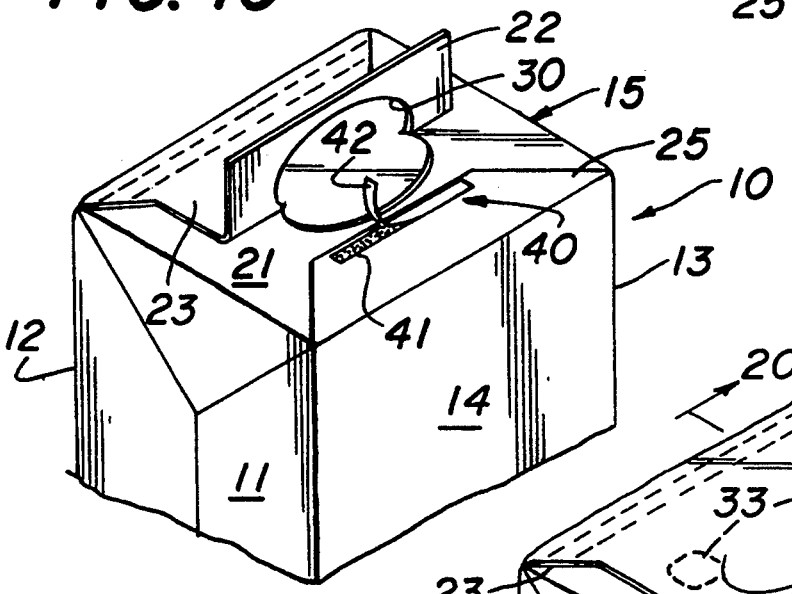
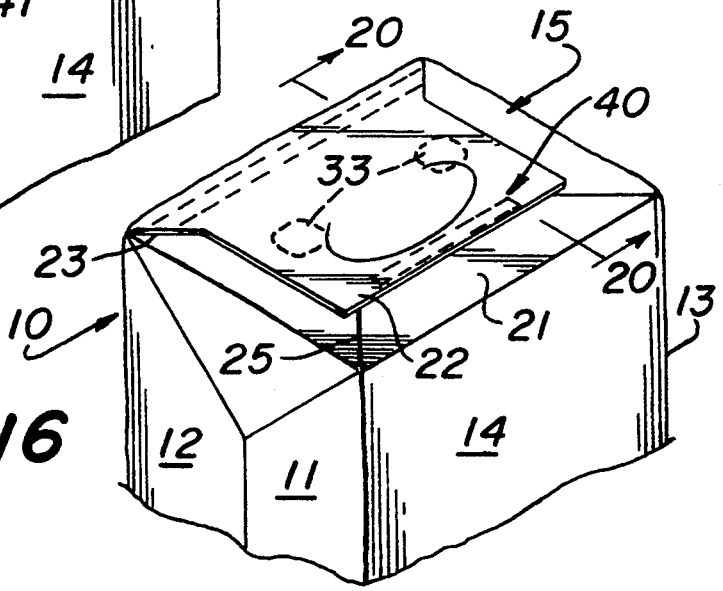
FIG. 16

BAG AND METHOD OF MAKING THE SAME

BACKGROUND OF THE INVENTION

1. Field of the Invention

This invention relates generally to bags and methods of making the same and, more particularly, to bags of the leakproof type having a rectangular end construction.

2. Description of the Prior Art

Bags of the indicated type are disclosed in U.S. Pat Nos. 2,496,796, 3,017,069, 3,342,402, 4,490,131, and 4,496,674. As disclosed in these patents, bags of this type generally comprise an outer sheet of paper and an inner liner of an impervious heat sealable material such as a plastic (synthetic resin). The bag is made of a tube and the bottom end of the bag is formed by making a diamond fold comprising a triangular fold portion and a partly rectangular tab fold portion. After the triangular fold portion and tab fold portion are sealed, the bottom of the bag is completed by folding over the tab fold portion onto a previously folded over triangular fold portion. The tab fold portion is caused to adhere to the bottom of the bag by applying suitable adhesive between the contiguous faces of the tab fold portion of the bag bottom structure. During this bottom forming procedure, the bag and the liner are in contiguous overlapping relation so as to form a single bottom structure having a two-ply configuration.

While the bags of the prior art are suitable in many applications, they have some limitations when they are used as containers for products such as pet food, coffee, or similar granular products and the like. For example, these products are typically packaged in "square-bottom" bags which have a pinched-top type of closure whereby there is a significant amount of unused "dead space", as referred to in the art. Thus, when these bags are stored on shelves, they are often stored in a non-upright position whereby they get crushed and lose their visual appeal to customers, particularly with respect to the display of the graphics thereon.

SUMMARY OF THE INVENTION

It is the general object of the invention to provide a bag which meets all or most of the following criteria:

(1) The bag will offer recycling capability.

(2) The bag will be capable of providing good, bold graphics on all faces thereof.

(3) The bag will be constructed so as to provide rigidity to the package so that it maintains its shape on the shelf.

(4) The bag will be provided with handle means usable for carrying and/or dispensing purposes.

(5) The bag will be provided with a fin seal construction which can be manipulated to provide a pour spout through which the contents of the packaged bag can be dispensed or to provide an opening through which access to the contents of the packaged bag can be attained by a measuring cup, spoon, or the like, for removing the contents of the bag.

(6) The bag will be provided with a re-closure means whereby after the contents thereof are partially dispensed therefrom, the dispensing opening can be re-closed.

(7) The packaged bag will be formed in the shape of a rectangular container having six sides. To this end, both the top and the bottom end of the bag are formed to provide a flat face extending across the top and bottom ends between four rectangularly arranged sides. By this arrangement, the graphics can be presented on all six sides of the bag so that, when the bag is displayed in the store shelf, it can be arranged to provide a display on any of the six sides and thereby offer consumer appeal for purposes of selling and informing the consumer.

BRIEF DESCRIPTION OF THE DRAWINGS

FIG. 1 is a perspective view of one embodiment of the invention showing a packaged bag in a filled condition, the top of the bag having a handle, a pour spout, and re-closure means.

FIG. 2 is a view of the bag shown in FIG. 1 with the top open to show its construction.

FIG. 3 is a view showing an alternate type of handle construction for use in a bag such as that shown in FIG. 1.

FIG. 4A is a section taken on line 4A—4A of FIG. 4.

FIGS. 12 to 14 show the method of opening the bag shown in FIG. 1 and dispensing its contents.

FIGS. 15 and 16 show the method of re-closing the top of the bag opened as shown in FIGS. 12 to 14 after use thereof.

DETAILED DESCRIPTION OF THE PREFERRED EMBODIMENTS

FIG. 1 discloses a packaged bag 10 in accordance with the invention comprising a six sided rectangular container having four sides 11, 12, 13, and 14 in a rectangular arrangement, a flat top 15 extending across and enclosing the top ends of the sides 11 to 14, and a flat bottom 16 extending across and enclosing the bottom ends of sides 11 to 14, as shown in FIG. 1. As will be described more fully hereafter, top 15 is constructed and arranged to provide a handle, a pour spout, and a re-closure means.

Bag 10 is made from a single sheet of film by the use of bag making machinery of the type well known in the art and described in the above-mentioned patents. A suitable film may comprise a multi-layer film of a single thickness that provides the necessary rigidity to the package as well as dead fold properties to maintain the folding of the crease lines of the sides of the bag so that it retains its rectangular overall shape and can provide the functions of the handle and the pour spout as will be described hereafter. While the material is preferably all plastic, combinations of plastic with other materials may be possible. A preferred all plastic film is one comprising a laminate consisting of an outer layer of a surface printed high density polyethylene, a white pigmented high density middle layer and a low density clear inner layer, the combination of the high density outer layer and the low density inner layer being such that the inner layer will melt at a lower temperature than the outer layer whereby heat sealing techniques may be used in the making of the bag. For example, a preferred outer layer material may comprise a high density polyethylene, which has a melting temperature of about 30° F. higher than that of the inner layer material. Of course, the selection of materials will have to be compatible with the product being stored within the packaged bag.

While various plastic materials may be used to make the bag, it is required that the bag be made of impervious, heat sealable material so that the bag may be sealed against outside air and moisture by heat sealing or other sealing techniques. While not as practical as heat sealing, it may be possible under some circumstances to perform the sealing by the application of an adhesive at desired places to cause the inner faces to adhere to each other at necessary locations.

Figure 4:
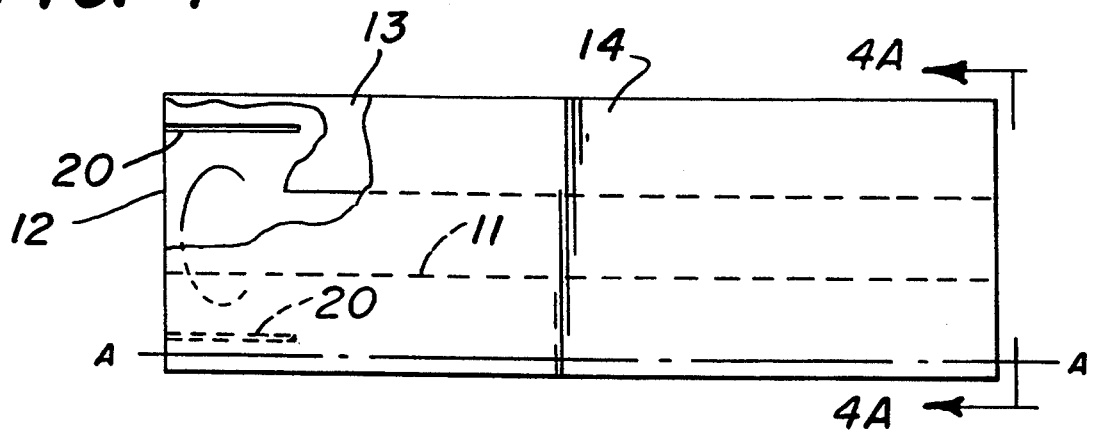
FIGS. 4 to 9 are views showing sequential steps in the making of the bag shown in FIG. 1.

The bag 10 of the invention is made from an intucked, flat bag tube such as the one shown in FIGS. 4 and 4A and which tube may be made by one of the automatic bag making machines well known in the art. The tube comprises a pair of opposed intucked sides 11 and 13 and a pair of opposed flat sides 12 and 14 as best shown in FIG. 4A. The medial portions of tube sides 11–14 form the sides 11–14, respectively, of the packaged bag 10 shown in FIG. 1, and the end portions of tube sides 11–14 are used to form the top 15 and bottom 16 of the packaged bag 10 as will be described hereafter. Typically, a longitudinal seam seal 11A is formed along overlapped tube portions extending along a centerline indicated at A—A in FIG. 4 and located at the juncture of sides 11 and 14 as shown in FIG. 4A.

The method of making the top of the bag 10 is illustrated in FIGS. 4 to 9.

Referring to FIG. 4, a pair of spaced apart parallel slits 20 are formed at the end portion of side 12 of the tube used to form the top 15 of the packaged bag 10. Slits 20 extend longitudinally from the top edge of the tube side 12 and are spaced equidistantly from the longitudinal side edges of side 12. Slits 20 define a rectangular tab 22 therebetween, as shown in FIG. 5.

Tab 22 is provided with a pair of arcuate cuts 30 forming a C-shaped cutout for providing a handle means in tab 22. Cuts 30 are made during the tube forming operation.

Figure 5:
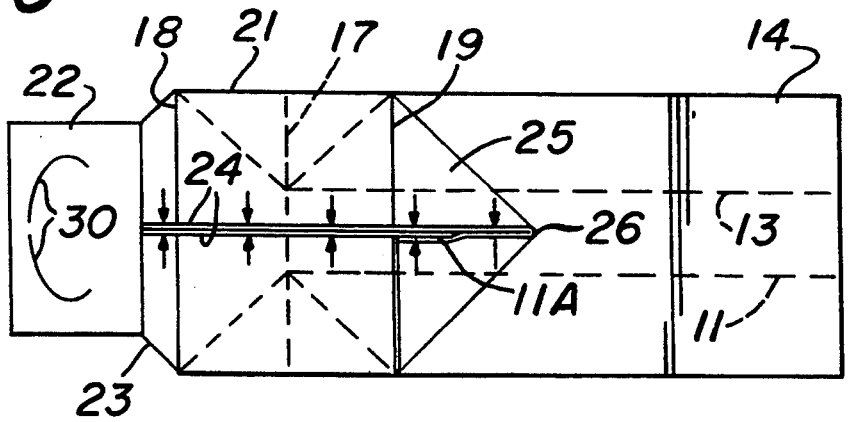

The next step of the method is to form the top end of the tube into a diamond fold as shown in FIG. 5 with a rectangular central portion 21, a partly rectangular fold portion 23 (including tab 22) located at one end, and a triangular fold portion 25 located at the other end. The diamond fold also comprises a pair of upwardly extending flaps 24 at the center thereof. Flaps 24 are united by a vertical fold 26 which is at the apex of the triangular fold portion 25 of the diamond fold. By this construction, there will be no opening in this area when the top of the bag is sealed as will be described hereafter. The diamond fold is also formed with a transverse center fold 17 and fold lines 18 and 19 located between central portion 21 and fold portions 23 and 25, respectively.

While the top of the bag 10 is being folded into the position shown in FIG. 5, a heat seal is applied along strips at right angles to flaps 24, as shown by the arrows in this Figure. This is the first sealing step in the sealing of the bag top 15. The centerline of this heat seal, known as the fin seal, is shown by dashed line 31 in FIG. 6. In this first sealing step, heat and pressure are applied in an amount necessary to cause the opposing inner faces of the film material within flaps 24, which comprise the film layer having the lower melting point, to adhere to each other and thereby seal the entire length thereof. The flaps 24 are then folded to the position shown in FIG. 6 and lie flush with the plane of the formed portion of the bag top.

Figure 6:
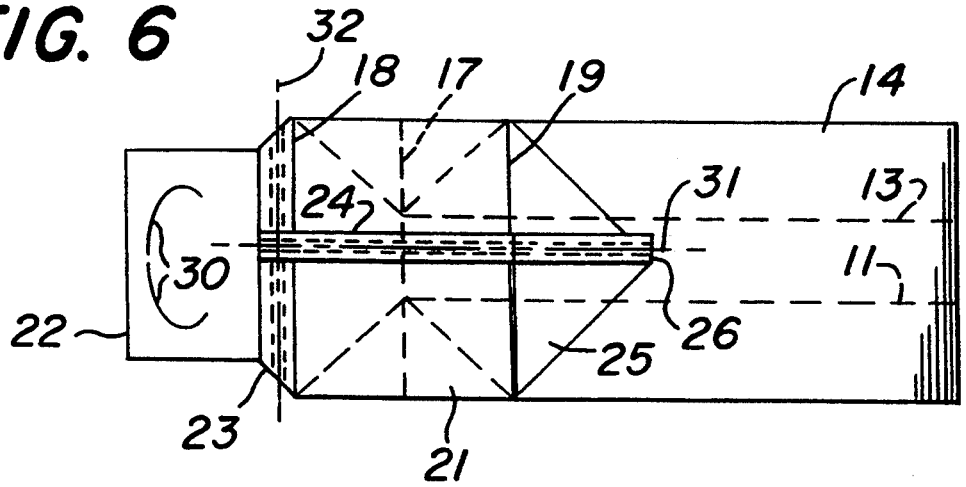

With the tube in the condition shown in FIG. 6, a heat seal is applied along a strip extending across the rectangular fold portion 23 of the bag top. This is the second step in the sealing of the bag top. The centerline of this heat seal, known as the cross seal, is shown by a dashed line 32 (FIG. 6) which intersects with centerline 31 of the fin seal at a location between tab 22 and the fold or crease line 18 upon which the final fold of the top portion of the bag will be made. In this second sealing step, heat and pressure are applied by a spring biased pressure roll across the strip centered on line 32 in an amount necessary to cause the opposing inner surfaces (which have a low melting point) of the film material to seal together.

Figure 7:
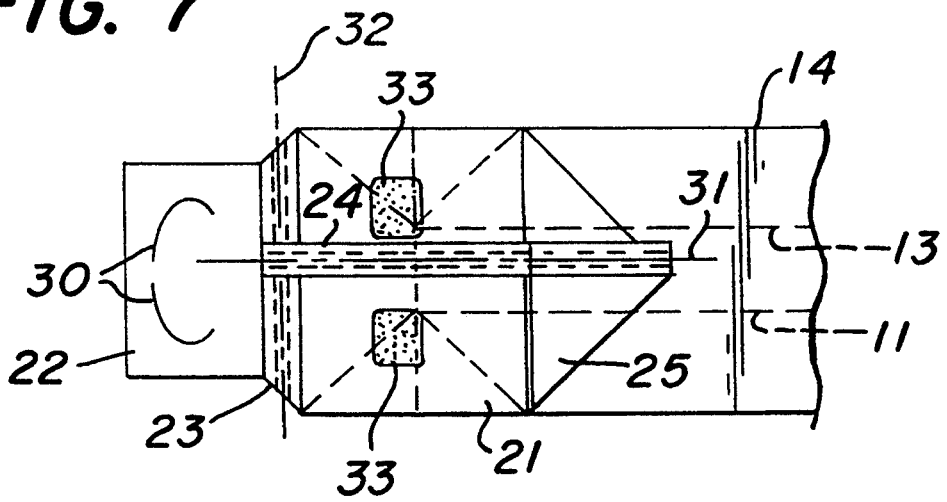
Figure 8:
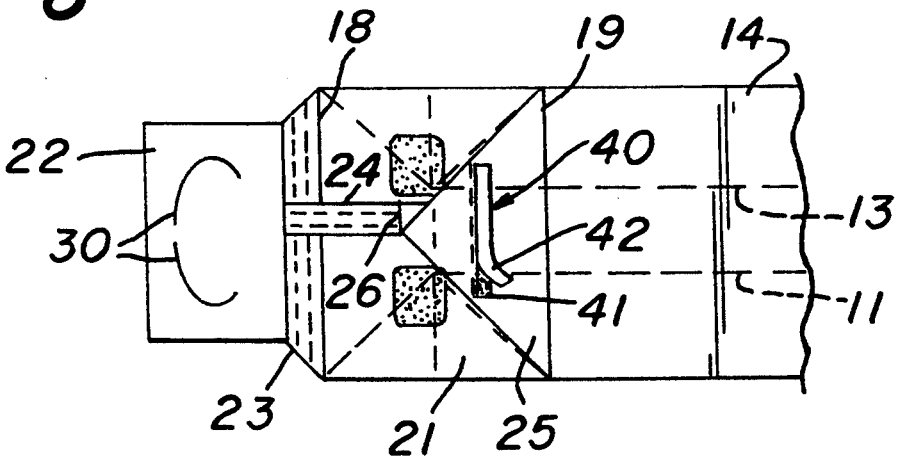
Figure 9:
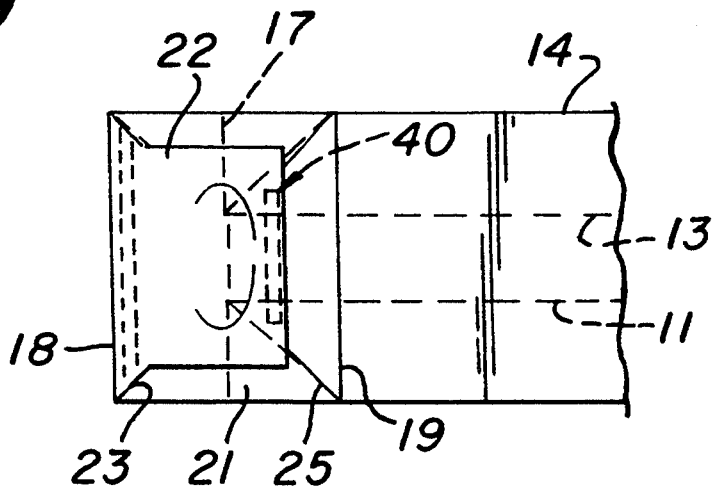

The next step in the bag making method is to apply deposits of glue or adhesive to the top portion of the tube with the tube in the flattened condition, which step is shown in FIG. 7. Adhesive is applied to a pair of spaced apart rectangular areas 33 of the central portion 21 at locations whereby when fold portion 25 is folded over onto central portion 21, as shown in FIG. 8, fold portion 25 will not be contacted by adhesive areas 33 and the apex portion of fold portion 25 will be located between adhesive areas 33. Adhesive areas 33 are also located so that when fold portion 23 is folded over onto central portion 21 and on top of fold portion 25, as shown in FIG. 9, adhesive areas 33 will come into adhering contact with the underside of tab 22. The purpose of this selected location of adhesive areas 33 will be described hereafter.

The next step in the bag making method is to fold the fold portion 25 along the fold or crease line 19 to the position shown in FIG. 8 wherein the triangular fold portion 25 is folded over to lie across the central portion 21 of the top of the bag in a flat condition. As shown in FIG. 8, the apex portion of triangular fold portion 25 is located to avoid contact with the adhesive portions 33. However, by reason of the folding procedure wherein the material of the bag accepts a fold in a manner so as to be retained in the folded condition, the triangular fold portion 25 is positioned to lie across the surface of the central portion 21 as shown in FIG. 8 in preparation for the next step.

With the bag in the position shown in FIG. 8, a re-closure means 40 is applied to the upwardly facing surface of triangular fold portion 25 at a location as shown in FIG. 8. The re-closure means 40 comprises a strip of adhesive 41 covered by a removable strip of material 42 which function to achieve a re-closure operation in a manner to be described hereafter. In FIG. 8, the strip 42 is shown partially removed from the adhesive 41 in order to better illustrate the construction. In the bag making procedure, the strip 42 will be retained in a flat position adhered to and covering the strip of adhesive 41 during the forming of the top of the bag.

The next step in the forming of the top of the bag is to fold the fold portion 23 along fold line 18 so that the rectangular tab 22 lies across the central portion 21 and overlaps the upper face of folded over triangular fold portion 25 in the areas as showing in FIG. 9. As shown in this figure, the tab 22 completely overlies the adhesive areas 33 as well as the re-closure means 40. During this step, the rectangular tab 22 is pressed into contact on top of the central portion 21 so that the adhesive areas 33 serve to adhere the tab 22 in overlapping relation with the triangular fold portion 23 to place the bag in the condition as shown in FIG. 9. By this construction, the tab 22 serves to releasably hold fold portion 23 in the position under tab 22 in a manner such that fold portion 23 can be manually removed from and inserted back into the held or retained position shown in FIG. 8.

This completes the formation of the top 15 of bag 10.

In its flattened tubular form shown in FIG. 9, the bag 10 is in condition for shipment to the place where the bag is to be filled. In this condition, only the top 15 of the bag construction which is to be packaged into the bag 10 shown in FIG. 1 has been completed. At the filling location, the bag is delivered to a conventional filling machine whereat the bag is positioned in an upright "squared" condition with the top 15 located at the bottom thereof and the other end opened up so at to be able to receive the contents which are poured therethrough into the interior of the opened bag. After filling, the end through which the bag has been filled is closed and becomes the bottom 16 of the packaged bag 10 in FIG. 1.

Figure 10:
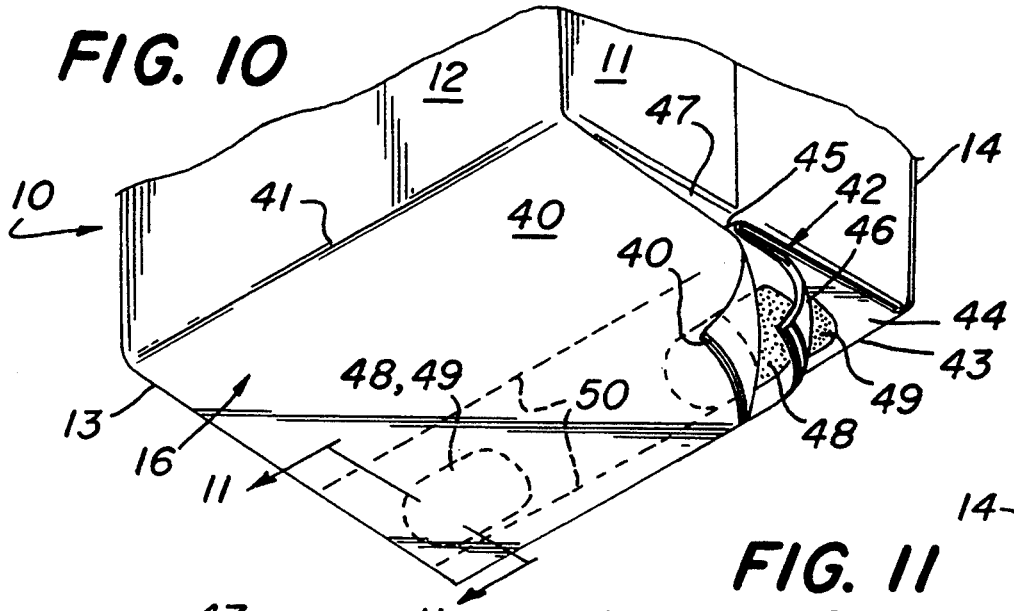
FIG. 10 is a partial view showing the bottom construction of the bag shown in FIG. 1.
Figure 11:
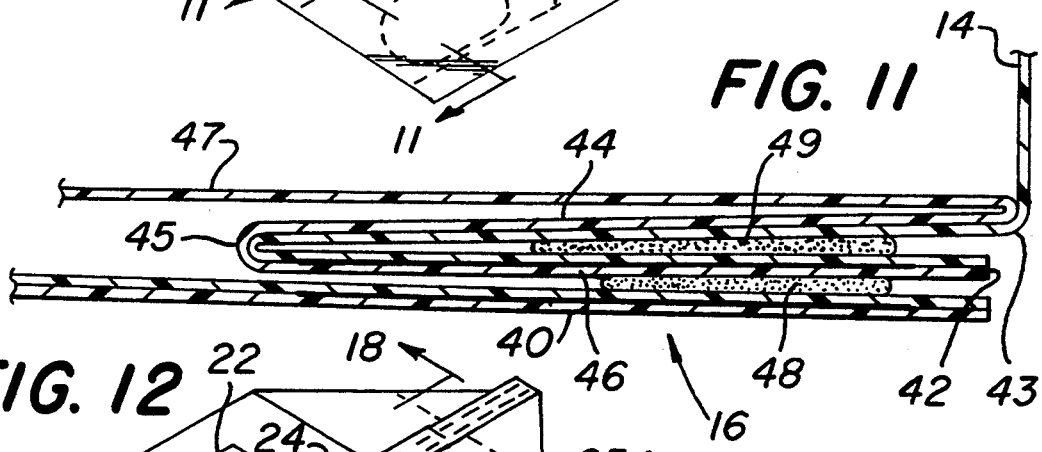
FIG. 11 is a section taken on line 11—11 of FIG. 10 showing the heat seals and glue areas.

Referring to FIGS. 10 and 11, the bottom 16 of the packaged bag 10 comprises an outer bottom flap 40 and an inner bottom flap 42. Outer bottom flap 40 is folded over along a fold line 41 which extends along the bottom edge of side 12. Outer bottom flap 40 is of a size to extend across the entire outer surface of bottom 16 as is shown in FIG. 10. Inner bottom flap 42 is folded over along a fold line 43, which extends along the bottom edge of side 14, so as to extend half way across the bottom 16 whereat it is folded back along the fold line 45, which extends across the center of bottom 16 parallel to fold line 43. Inner bottom flap 42 comprises two half portions 44 and 46 by reason of the construction as described above and shown in FIG. 10. As shown in FIG. 11, the arrangement is such that the half portion 46 is sandwiched between the inner surface of outer flap 40 and the outer surface of half portion 44. The mating faces between outer flap 40 and half portion 46 are adhered together by means of adhesive provided at two areas 48. Likewise, the mating faces between half portions 46 and 44 are secured together by adhesive provided at two areas 49 aligned with areas 48. Bottom 16 also comprises a pair of triangular-shaped bottom flap portions 47 extending inwardly from both bottom ends of sides 11 and 13, and being formed by the gussetted portions at the lower ends of said sides 11 and 13. The parts of bottom 16 are secured in the position shown in FIG. 10 by the application of a heat seal along a wide strip indicated at 50 extending across the overlapped areas of the bottom flaps 40 and 42 as discussed above.

Figure 12:
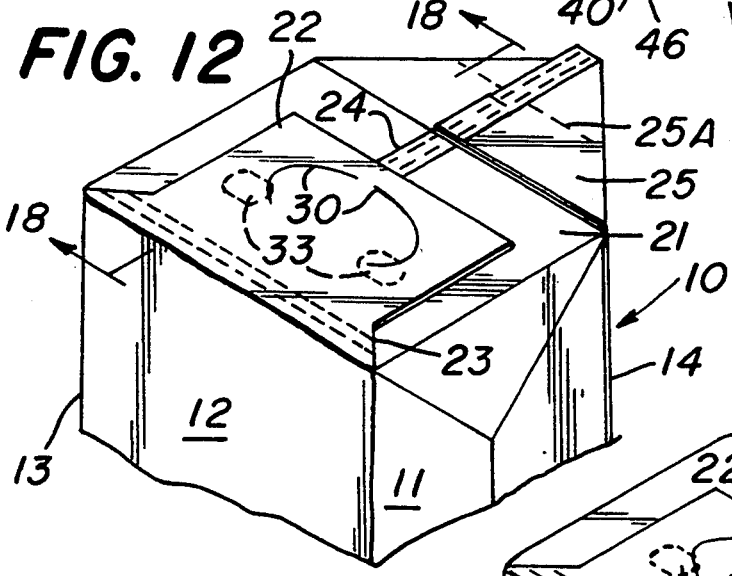
Figure 13:
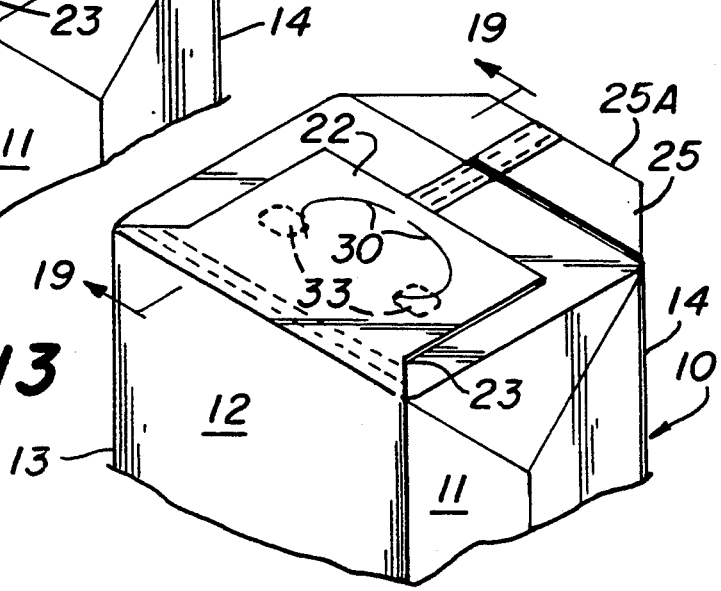
Figure 17:
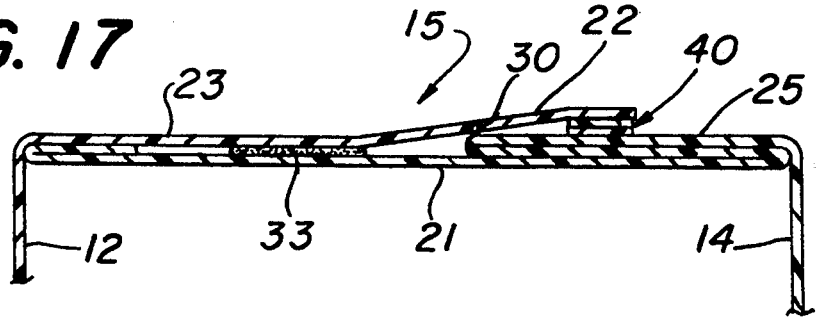
FIG. 17 is a section taken on line 17—17 of FIG. 1 showing the closed top of the bag.
Figure 18:
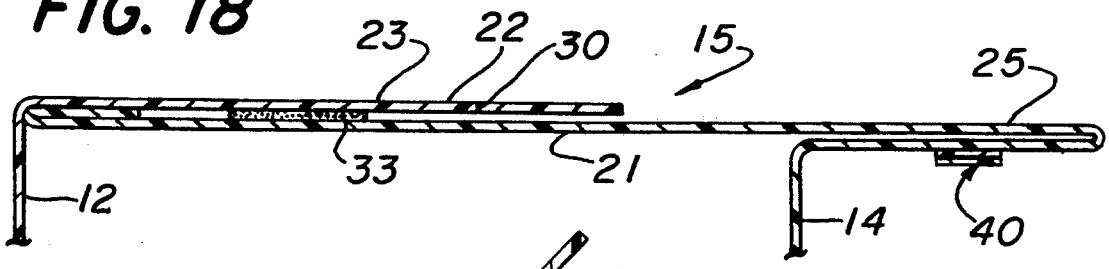
FIG. 18 is a section taken on line 18—18 of FIG. 12 showing the partially open top of the bag.

The manner in which the contents of the packaged bag 10 are dispensed therefrom is illustrated in FIGS. 12–14. The first step in the dispensing procedure is to remove fold portion 25 from its held position on the underside of tab 22 of fold portion 23 by manually pulling it out of the held position and bending fold portion 25 to the position as shown in FIG. 12 extending away from top 15. FIG. 18 also illustrates the condition of the parts when the fold portion 25 has been moved to its extended position and shows that fold portion 25 defines an inner enclosed space which communicates with the interior of bag 10 whereby the contents in the interior of the bag 10 are in flow communication with the interior space of the fold portion 25.

Figure 19:
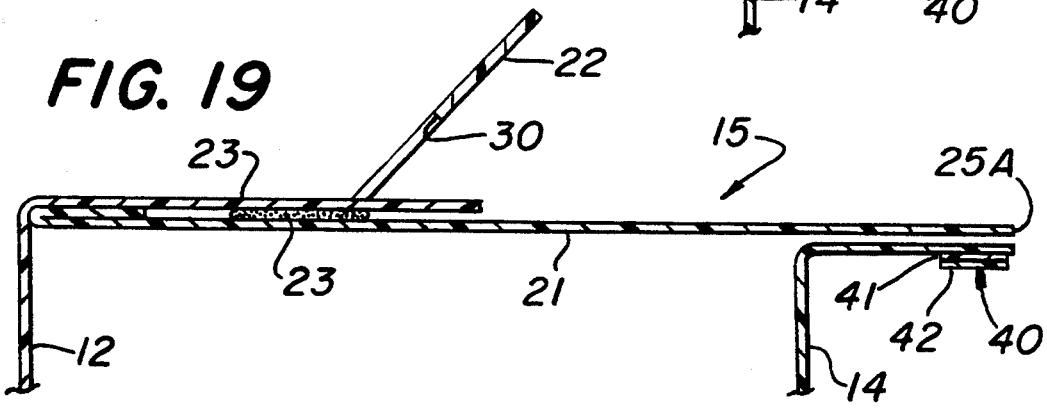
FIG. 19 is a section taken along line 19—19 of FIG. 13 showing the cut-open top of the bag.
Figure 20:
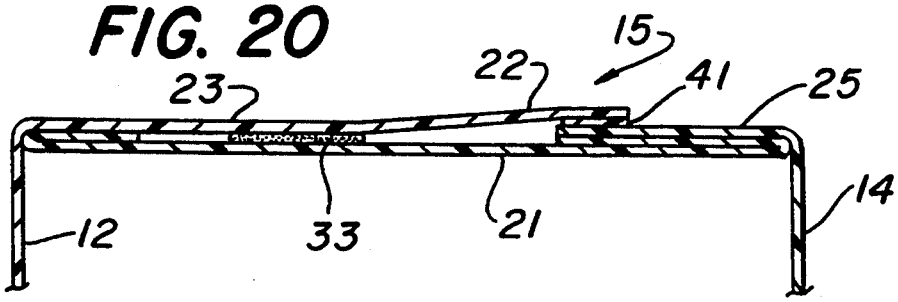
FIG. 20 is a section taken on line 20—20 of FIG. 16 showing the re-closed top of the bag.

The next step in the dispensing procedure is to cut fold portion 23 along a line indicated by the cut line 25A in FIG. 12 to remove an apex portion of fold portion 23 at its outer end. After this cut has been made, the top 15 is in the condition as shown in FIGS. 13 and 19 which show that the remaining portion of fold portion 25 provides a pour spout through which the contents within the packaged bag 10 can be dispensed therefrom.

The dispensing operation is illustrated in FIG. 14 which shows that the cutouts 30 and the portion of tab 22 extending beyond the glued down portion thereof form a handle that can be used to hold the top end of the packaged bag 10 as it is tilted to a position as shown in FIG. 14 to dispense the contents through the pour spout provided by the cutoff fold portion 25.

As discussed above, top 15 of the packaged bag 10 is also provided with a re-closure means 40 for securing the top 15 in a closed condition after part of the contents thereof have been dispensed and it is necessary to store the remaining contents in a safe, closed condition. FIGS. 15 and 16 illustrate the re-closure procedure whereby the top 15 of bag 10 is returned to a closed condition in a manner to provide a securely closed container whereby the contents cannot be spilled therefrom during storage thereof. Also, in the case of a pet food container or the like, the re-closed condition prevents a pet, or insects, from gaining access to the contents.

The first step in the re-closure procedure is to bend the cutoff fold portion 25 back to the position as shown in FIG. 15 wherein it lies flat on top of the central portion 21 of top 15. Also, the peel strip 42 is removed from the adhesive strip 41 whereby the adhesive strip 41 is presented in an exposed upwardly facing condition. The re-closure procedure is completed by pressing the underside of tab 22 of fold portion 23 onto the exposed surface of the adhesive strip 41 so as to attach tab 22 and fold portion 23 together in an adhesive connection provided at adhesive strip 41. It is noted that the adhesive connection between adhesive strip 41 and tab 22 is such that the tab 22 can be separated from its adhering connection to fold portion 23 by peeling the same from its adhered position. This separation is possible by reason of the proper selection of a "peel" type of adhesive in the formation of adhesive strip 41, as is known in the art. Accordingly, when it is desired to dispense more contents from the packaged bag 10, the tab 22 is peeled from its adhering condition onto fold portion 25 and the bag 10 is returned to a dispensing condition as shown in FIG. 14, whereby the contents can be dispensed therefrom as described above.

FIG. 3 illustrates a bag construction comprising an alternate type of handle means wherein a handle opening is formed by a pair of circular cutouts 30A located in tab 22 in an arrangement similar to the cutouts 30. The pair of cutouts 30A provide two holes into which the fingers of the user may be inserted for use in carrying the bag or during a dispensing operation.

Figure 21:
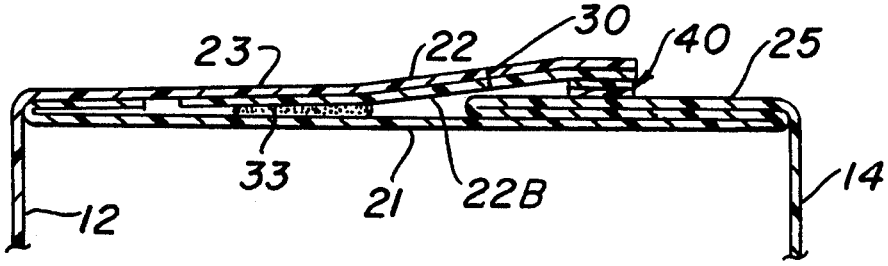
FIG. 21 is a sectional view showing an alternate type of handle construction wherein the handle is formed by a double thickness of film.

FIG. 21 illustrates a bag construction comprising a stronger handle means. In order to provide a stronger handle means, a rectangular sheet 22B of film material is laminated to the underside of tab 22. Sheet 22B is of the same rectangular dimension as tab 22 and thereby provides a double thickness of material in the region of the handle means. The cutouts 30 for providing the opening of the handle are formed to extend through both the thicknesses of the two-ply handle means, namely the thicknesses provided by tab 22 and sheet 22B.

Figure 22:
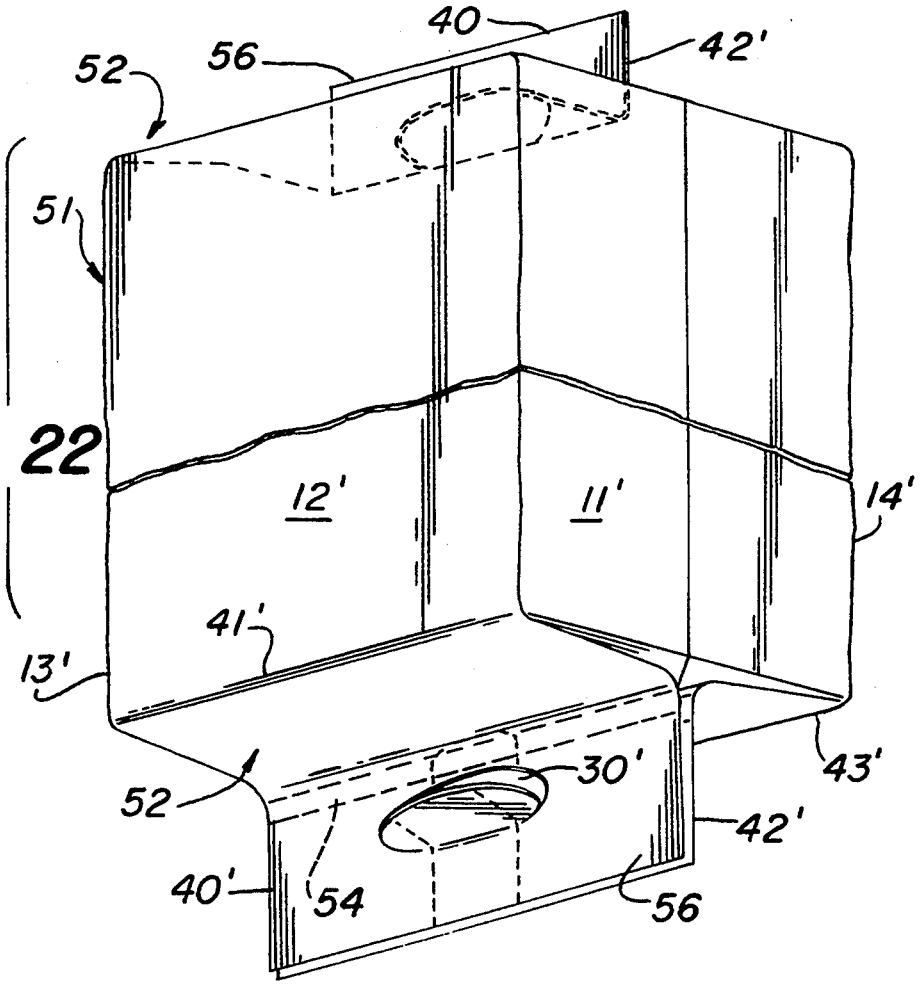
FIGS. 22 and 23 are views showing another embodiment of the invention comprising a large sized bag with handles formed at either end.
Figure 23:
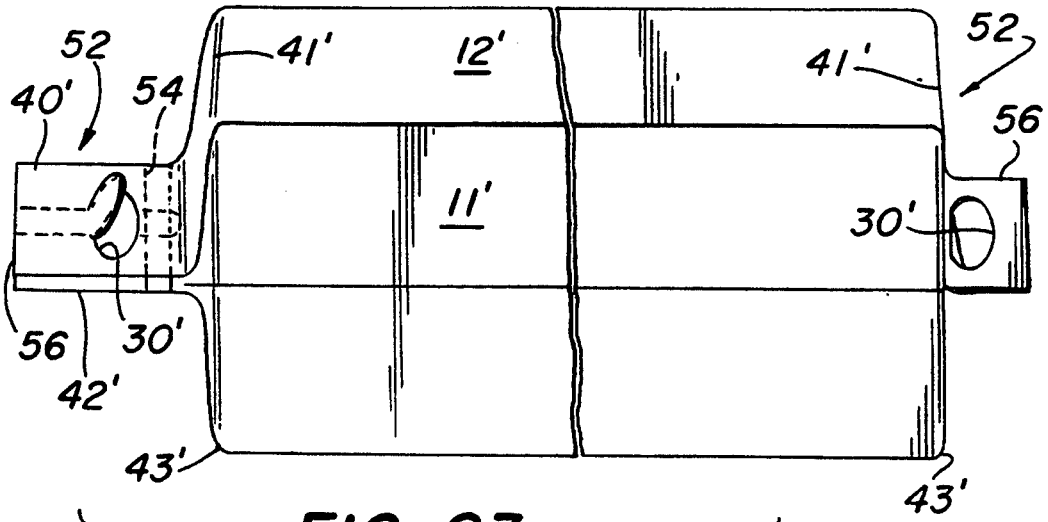

FIGS. 22 and 23 disclose an embodiment of the invention which is adapted for large size bags. The packaged bag 51 shown in FIGS. 22 and 23 is similar to the bag 10 wherefore corresponding parts have been given the same reference numerals with primes added. The main difference between bags 10 and 51 is that in the case of bag 51 both ends 52 thereof are similar to the bottom 16 of bag 10 except that they are modified to provide a handle at each end. Thus, each end 52 of bag 51 comprises a flap 40' and a flap 42' folded over along fold lines 41' and 43' which extend along the bottom edges of sides 12' and 14', respectively. Each of the flaps 40' and 42' comprises first half portions which extend across the end of the bag 51 to the center thereof whereat they are folded to extend at right angles to the flat end provided by the first half portions. Flaps 40' and 42' are provided with second half portions which extend in overlapping relation away from the central portion of the flat ends. A heat seal 54 is applied adjacent the innermost ends of the second half portions of flaps 40' and 42' as shown in FIGS. 22 and 23 to secure the flaps together at this central portion. By this arrangement, the extending second half portions of flaps 40' and 42' provide a rectangular tab 56 that extends from the ends 52 of the bag 51. These tabs 56 are provided with an arcuate cutout 30' forming a C-shaped cutout for providing a handle means. By reason of the provision of a handle means at each end of the bag 51, bag 51 can be made in large sizes and the handle means at each end provide a convenient means for carrying the bag 51.

Figure 24:
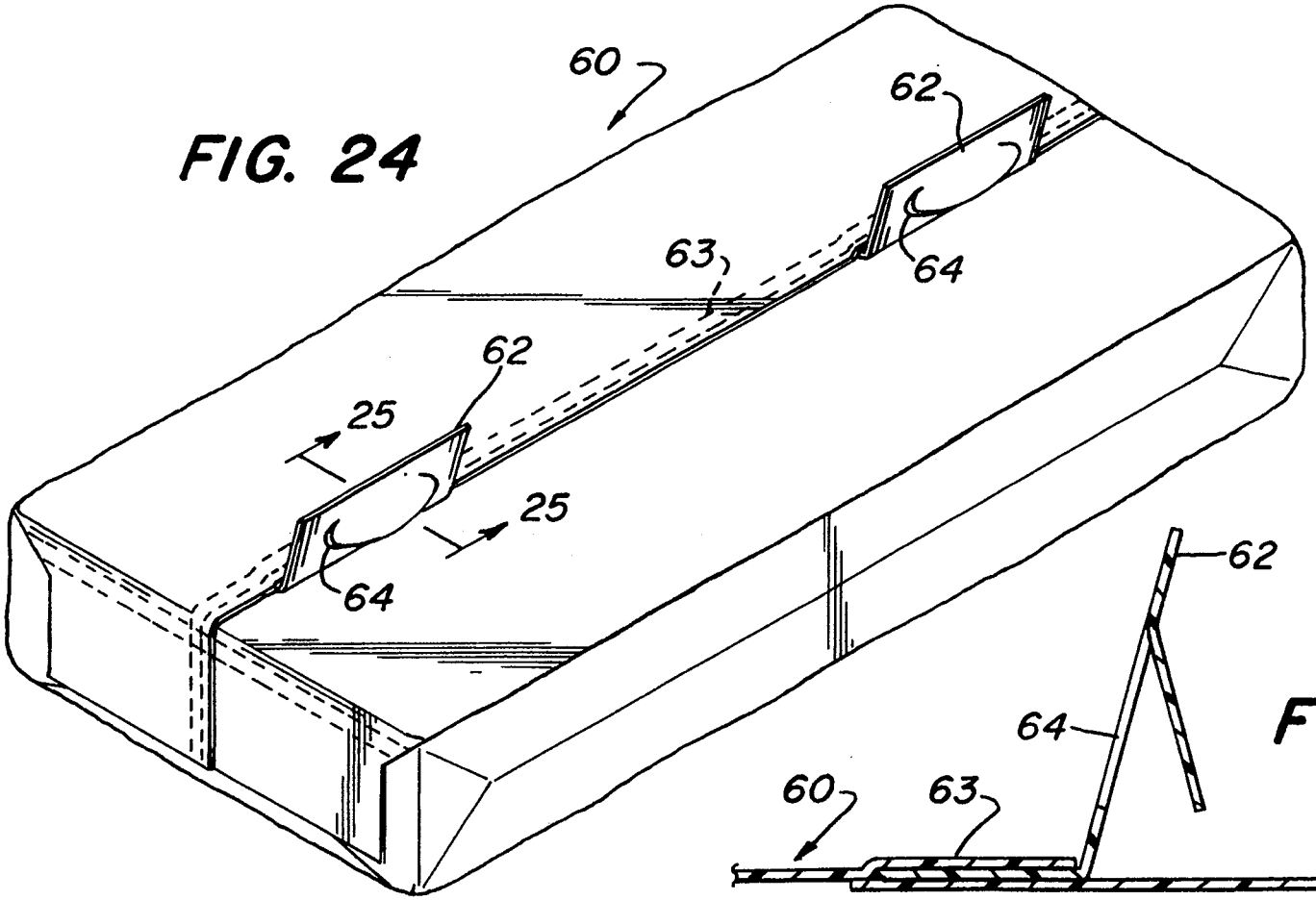
FIGS. 24 and 25 are views of another embodiment of the invention comprising a large size bag having handles extending from the side seam of the bag.
Figure 25:
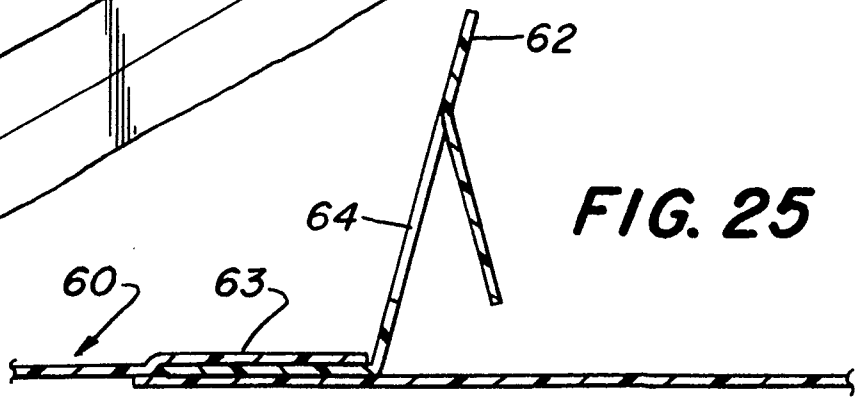

FIGS. 24 and 25 illustrate another embodiment of the invention adapted for large size bags. In the case of large size bags having a rectangular configuration, it is difficult for someone to pick the bag off a shelf and then lift it up to the height of a cart or the like with the handle located only on the top of the bag. To obviate this problem, the bag 60 shown in FIGS. 24 and 25 is provided with a pair of tabs 62 which are attached to the longitudinal seam 63 of the bag 60. Each of the tabs 62 has a rectangular configuration and is provided with an arcuate cut 64 forming a C-shaped cutout for providing a handle means in the tab. By this arrangement, the bag 60 can be carried by the use of two hands which can be inserted into the handle openings provided by the cutouts 63 in each of the tabs 62 as illustrated in FIGS. 24 and 25. The longitudinal seam 63 can be located at various places on bag 60, such as at a corner as in bag 10.

Figure 26:
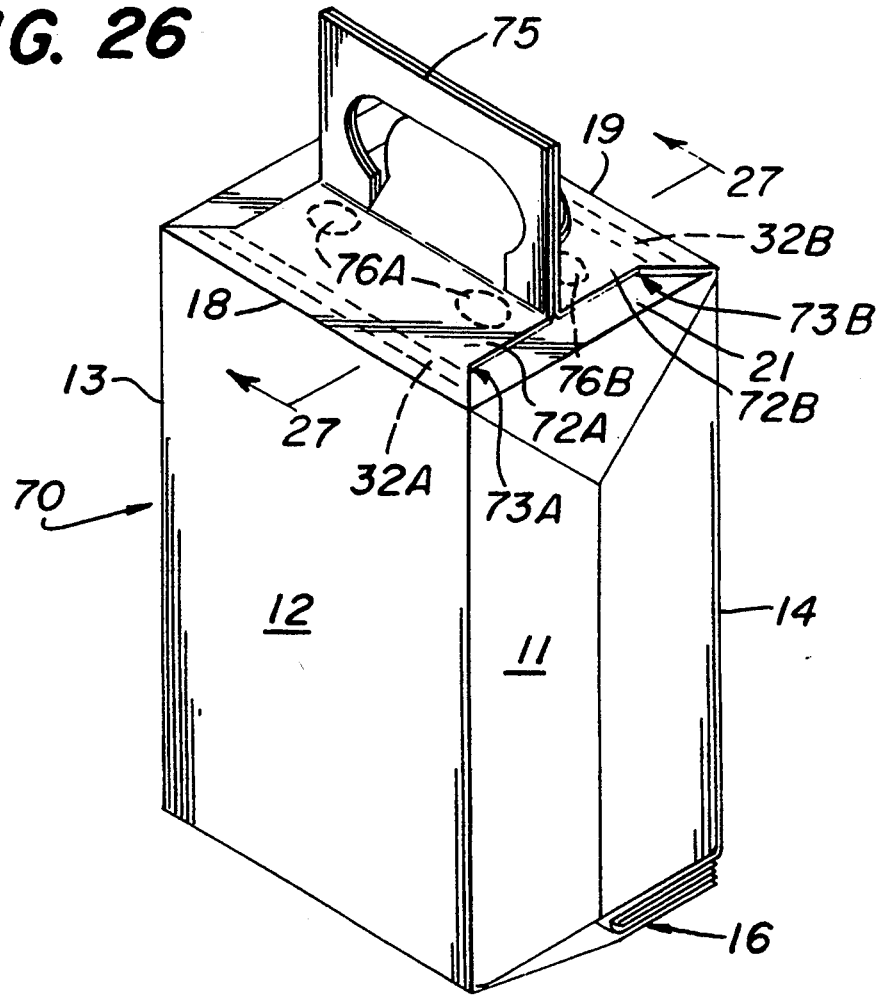
FIGS. 26 and 27 are views showing another embodiment of the invention comprising another type of handle construction.
Figure 27:
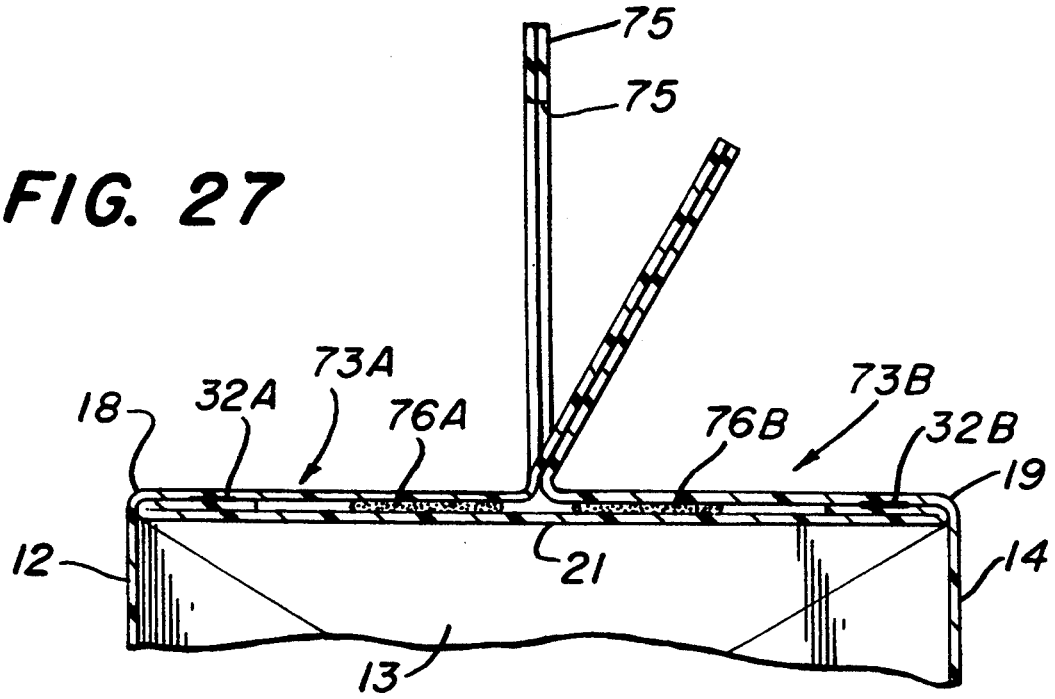

FIGS. 26 and 27 illustrate another embodiment of the invention comprising a construction having a stronger handle means. The bag 70 shown in FIGS. 26 and 27 is similar to the bag 10 wherefore corresponding parts have been given the same reference numerals. The only difference between the bags 10 and 70 is in the formation of the top end thereof. Thus, bag 70 comprises sides 10 to 14 and a bottom 16 constructed in the same manner as the bag 10. The top of bag 70 is formed by a partial diamond fold having a rectangular central portion 21 similar to that portion of bag 10, a partly rectangular fold portion 73A (including a rectangular tab 72A) located at one end, and a partly rectangular fold portion 73B (including a rectangular tab 72B) located at the other end. The fold portions 73A and 73B are formed to be similar to the fold portion 23 of bag 10 except that the rectangular tabs 72A and 72B, respectively, have a greater length in the direction extending away from the fold lines 18 and 19 at the base of fold portions 73A and 73B, respectively. As shown in FIGS. 26 and 27, the extended length of the tabs 72A and 72B are used to form a rectangular tab 75 which extends upwardly from the center of the central portion 21. To this end, tab portions 72A and 72B overlap in the outer end portions thereof, the overlapping portions of said tabs being adhered together as by the application of a pressure and heat seal.

During the formation of the partial fold and when the parts are in a flattened condition, heat seals are applied along the strips 32A and 32B extending across the rectangular fold portions 73A and 73B, respectively. Heat seals 32A and 32B are cross seals and correspond to the cross seal shown by the dashed line 32 of the bag 10. These two cross seals 32A and 32B serve to completely seal the top end of the bag 70. The parts of the rectangular tabs 72A and 72B which extend across the central portion 21 are adhered to this central portion by areas of adhesive 76A and 76B as shown in FIGS. 26 and 27. The rectangular tab 75 is provided with an arcuate cutout 77 providing an opening therein whereby tab 75 can be used as a handle means for the bag 70 as is apparent from a consideration of FIGS. 26 and 27.

The embodiment of the invention shown in FIGS. 28 to 31 illustrates a construction for small size bags. In the case of a small size bag, such as one of about a one pound size, the need for a handle on the top is not evident because the customer can pick up the bag and handle it by holding the sides of the bag. The bag 80 shown in FIGS. 28 to 31 is essentially the same as bag 10 except that it is not provided with a handle means and it is provided with a modified type of dispensing arrangement. Accordingly, the bag 80 will be described by the use of reference numerals the same as that of bag 10 except for the modified parts which will be given the same reference numerals with primes added. Thus, bag 80 is comprises a six sided rectangular container having four sides 11 to 14, a flat top 15' extending across and enclosing the top ends of sides 11 to 14 and a flat bottom (not shown) the same as the bottom 16 of bag 10. The bag 80 is provided with a tab 22' which is similar to tab 22 of bag 10 except that it is not provided with any cutout for use in providing a handle means. The top end of the bag is formed in a manner similar to that of bag 10 and comprises a rectangular central portion 21, a partly rectangular fold portion 23 (including tab 22') located at one end, and a triangular fold portion 25 located at the other end. The diamond fold also comprises a pair of upwardly extending flaps 24 at the center thereof which are united by a vertical fold 26 which is at the apex of the triangular fold portion 25. The diamond fold is also formed with fold lines 18 and 19 located between central portion 21 and fold portions 23 and 25, respectively.

The bag 80 is also provided with a fin seal 31' similar to that of bag 10. The fin seal 31' of the bag 80 is located at overlapping flaps 24 and differs from that of bag 10 only in that a different type of adhesive is used. More particularly a peel-type of adhesive is used for the bag 80 for a purpose to be described more fully hereafter. The top 15' of bag 80 is also provided with a cross seal similar to that of bag 10 and indicated at 32. The cross seal 32 and the fin seal 31 intersect at a location between tab 22' and the fold or crease line 18 as described above with respect to bag 10 to thereby seal the top of the bag completely.

The adhesive is applied to a pair of spaced apart areas 33' of the central portion 21 at locations whereby when fold portion 25 is folded over onto central portion 21, fold portion 25 will not be contacted by the adhesive areas 33' as in the case described above with respect to the bag 10. One difference is that the adhesive used to provide adhesive areas 33' is a "peel" type of adhesive.

Figure 28:
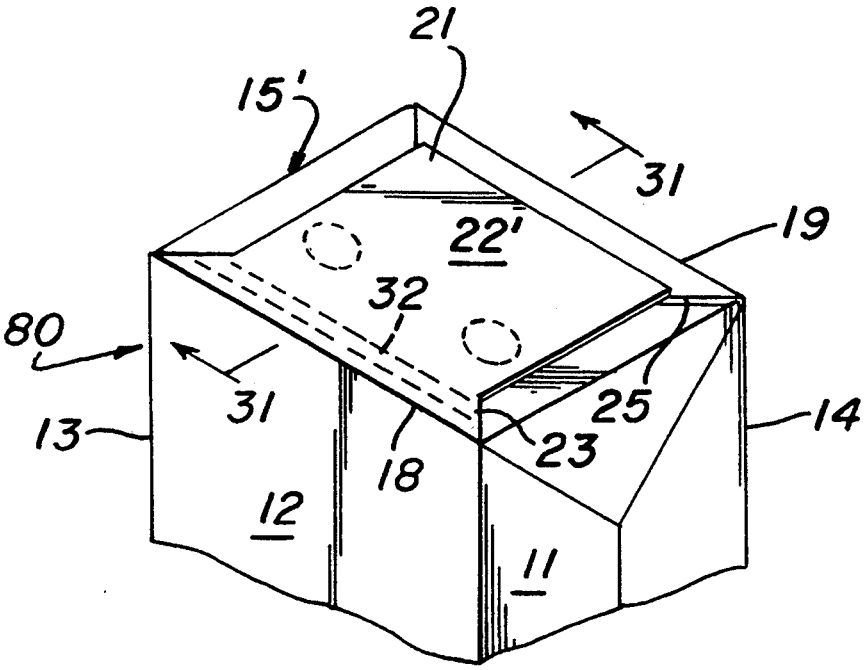
FIGS. 28 to 31 are views of another embodiment of the invention comprising a pour spout means constructed of a peel seal construction.

In the making of the bag 80, the fold portion 23 is folded over on line 19 to lie flush with the central portion 21 after which the fold portion 25 is folded over on fold line 19 to the position as shown in FIG. 28 to lie across the central portion 21 of the top of the bag in a flat condition. The procedure is the same as described above with respect to bag 10. The final step in the forming of the top of the bag is to fold the fold portion 23 along fold line 18 so that the rectangular tab 22' lies across the central portion 21 and overlaps the upper face of folded over triangular fold portion 25 in the areas as described above. Tab 22' completely overlies the adhesive areas 33' as well as the apex of the triangular fold portion 23. Tab 22 is pressed into contact on top of the central portion 21 so as to be adhered thereto by the adhesive areas 33'. As described above, the tab 22' serves to releasably hold fold portion 23 in the position thereunder in a manner such that fold portion 23 can be manually removed and inserted back into the retained position shown in FIG. 28.

Figure 29:
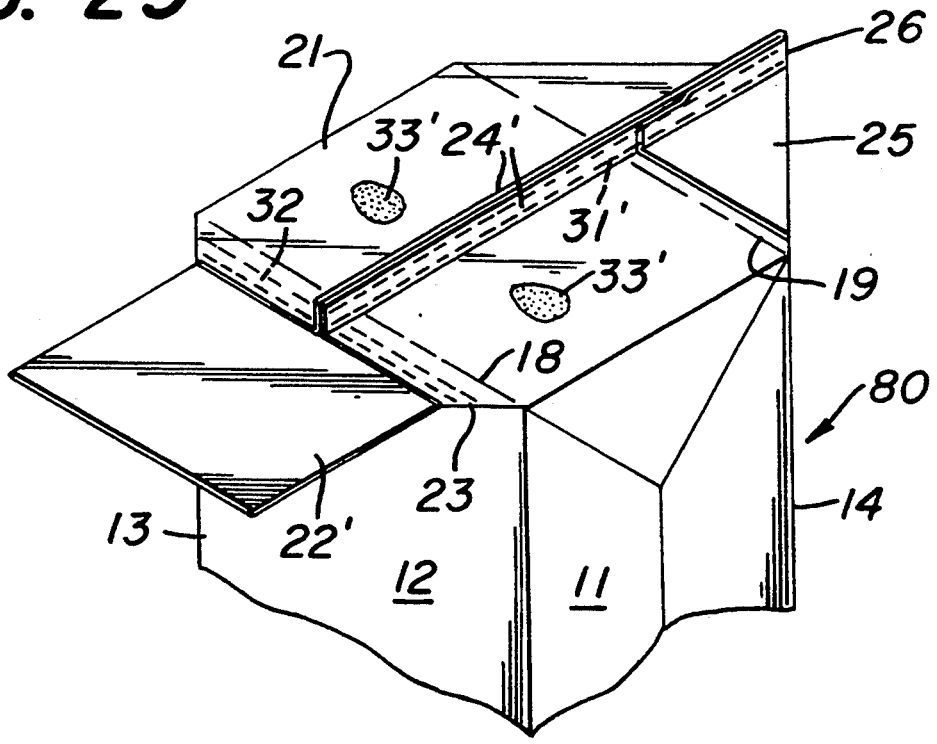
Figure 30:
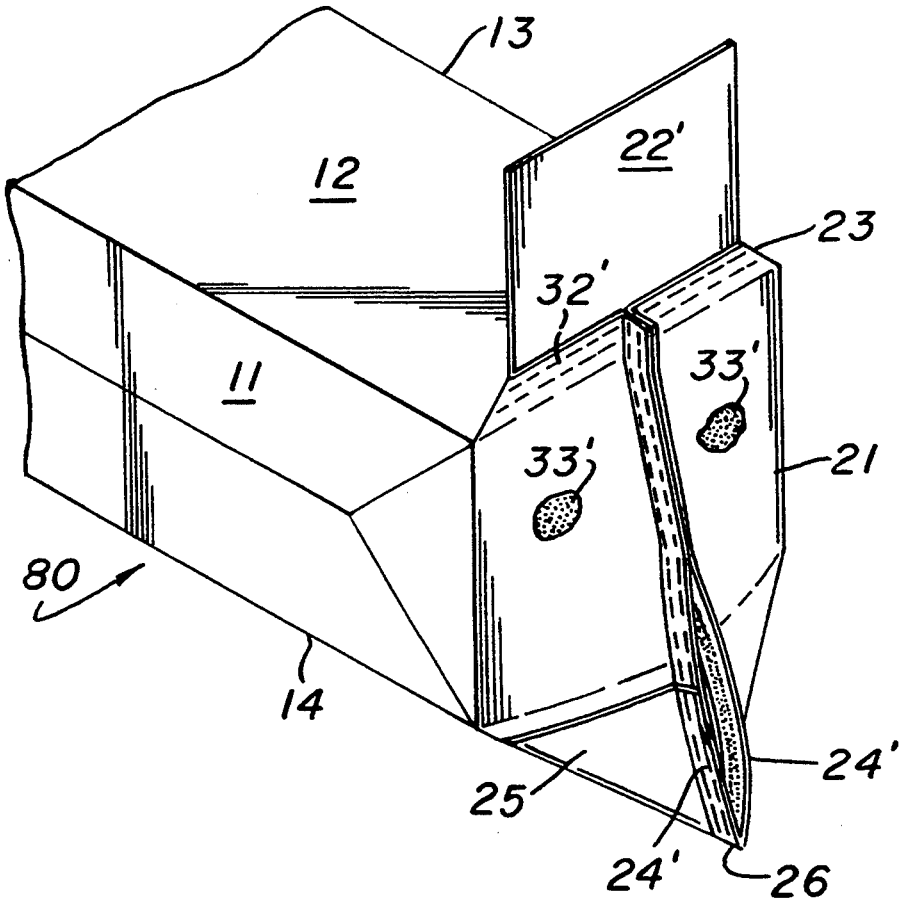
Figure 31:
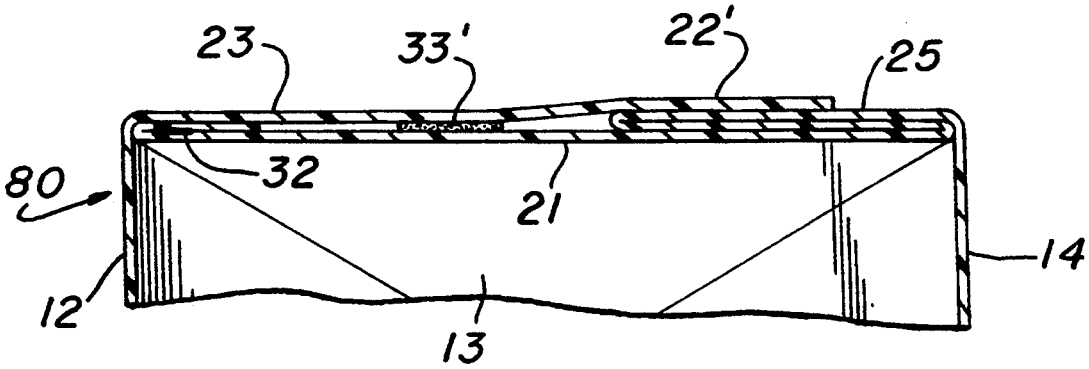

The manner in which the contents of the bag 80 are dispensed therefrom is best shogun in FIGS. 29 and 30. The first step in the dispensing procedure is to remove the fold portions 25 and 23 from their position held on the central portion 21 to place the parts in the position shown in FIG. 29. The next step in the dispensing procedure is to peel apart the fin seal 31' at flaps 24 to open the apex portion of fold portion 25 at its outer end. As discussed above, fold portion 25 defines an inner enclosed space which communicates with the interior of the bag 80 whereby the contents in the interior of bag 80 are in flow communication with the interior space of fold portion 25. When fin seal 31 has been peeled apart, the top 15' of bag 80 is in a condition as shown in FIG. 30, which shows that fold portion 25 provides a pour spout through which the contents of the bag can be dispensed therefrom. During the dispensing procedure, the bag is tilted to the position shown in 30 by the user who holds the bag by grasping the sides thereof. After the dispensing procedure is completed, the peel-type of fin seal 31' is re-closed by pressing the flaps 24 together whereby bag 80 is returned to a closed condition to store the remaining contents in bag 80 in a safe closed condition.

What is claimed is:

1. In a bag of the gussetted flat-ended type having a generally rectangular flat first end formed by a diamond fold having at its ends a first fold portion and a triangular fold portion, said fold portions being folded along parallel spaced apart fold lines forming side edges of the bag end, the portion of the diamond fold between said fold lines providing a rectangular central portion, said fold portions overlap one another in a folded condition thereof, the improvement comprising:

means for adhesively securing the first fold portion to said central portion at spaced apart adhesive areas on said central portion, said triangular fold portion being folded over underneath said first fold portion and having an apex portion located opposite the respective fold line of the triangular portion, said first fold portion having a rectangular tab opposite the respective fold line of the first fold portion in contact with said adhesive areas to secure said rectangular tab to said central portion of the bag end and overlie said apex portion of said triangular fold portion, said apex portion of said triangular fold portion being releasably held between said tab and said central portion in the folded condition of the first end and being slidably removable from said held position for use in dispensing contents of a packaged bag.

2. A bag according to claim 1 including means providing a handle on said first fold portion for use in holding a packaged bag during the dispensing of the contents thereof.

3. A bag according to claim 2 wherein said handle means comprises a cutout formed in said tab to provide a handle opening.

4. A bag according to claim 2 including re-closure means for securing said triangular fold portion to an underside of said tab after a dispensing operation.

5. A bag according to claim 4 wherein said re-closure means comprises a peel strip provided on said triangular fold portion, said peel strip means comprising a strip of a peel type adhesive and a strip of material covering the same and removable therefrom for use in adhering the triangular fold portion to an underside of said rectangular tab.

6. A bag according to claim 1 wherein said bag is formed into the shape of a rectangular container having six sides with said first end located at the top end thereof and a second generally rectangular flat second end located opposite said first end.

7. A bag according to claim 1 including re-closure means for securing said triangular fold portion to an underside of said tab after a dispensing operation.

8. A bag according to claim 1 wherein said selected adhesive areas comprise two spaced apart areas located to have the apex portion of said triangular fold portion extend therebetween in the folded over condition of said triangular fold portion.

9. A bag according to claim 1 including means providing a handle on said first fold portion for use in holding a packaged bag during the dispensing of the contents thereof, said handle means comprising a rectangular sheet of material attached to said rectangular tab to provide a double thickness thereof and a cutout formed in said double thickness of tab to provide a handle opening.

10. A bag according to claim 1 including a fin seal located at the outer edge of said diamond fold, said fin seal being formed by a peel type of adhesive whereby said fin seal can be manually opened for use and dispensing the contents of the bag.

* * * * *